US006983685B2

(12) United States Patent
Ko

(10) Patent No.: US 6,983,685 B2
(45) Date of Patent: Jan. 10, 2006

(54) GARBAGE CAN CAPABLE OF COMPRESING GARBAGE VOLUME

(76) Inventor: Wen-Hsiung Ko, No. 8, Lane 339, Pei-Yang Rd., Feng-Yuan, Taichung (TW)

( * ) Notice: Subject to any disclaimer, the term of this patent is extended or adjusted under 35 U.S.C. 154(b) by 205 days.

(21) Appl. No.: 10/173,599

(22) Filed: Jun. 19, 2002

(65) Prior Publication Data

US 2003/0233949 A1 Dec. 25, 2003

(51) Int. Cl.
*B30B 15/30* (2006.01)

(52) U.S. Cl. ..... 100/229 A; 100/59; 100/61; 100/227; 100/266; 100/268; 220/263; 220/908

(58) Field of Classification Search ..... 100/59, 100/61, 227, 229 A, 245, 266, 268; 220/908, 220/578, 263

See application file for complete search history.

(56) References Cited

U.S. PATENT DOCUMENTS 2,968,235 A * 1/1961 Marica ..... 100/218
3,654,855 A * 4/1972 Longo ..... 100/229 A
3,659,427 A * 5/1972 Harza ..... 62/63
3,736,863 A * 6/1973 Brucker ..... 100/45
3,771,437 A * 11/1973 Brucken ..... 100/52
3,834,299 A * 9/1974 Bourgeois et al. ..... 100/229 A
4,146,178 A * 3/1979 Bailey ..... 239/90
5,042,374 A * 8/1991 Klepacki ..... 100/229 A
5,170,904 A * 12/1992 Neuhaus ..... 220/262
5,220,866 A * 6/1993 Mason et al. ..... 100/221
5,440,978 A * 8/1995 O'Brien et al. ..... 100/99
6,206,231 B1 * 3/2001 Laughton ..... 220/827

* cited by examiner

*Primary Examiner*—William Hong
(74) *Attorney, Agent, or Firm*—Troxell Law Office PLLC

(57) ABSTRACT

A garbage can capable of compressing garbage volume consists of an outer cylinder and a top cylinder. A top cover has a top plate with a through hole. The circumference of the top plate extends downwards to form an inner wall and the outer circumference of the top plate extends downwards to form an outer wall such that a space between the outer and inner walls can be formed. The front and the back sides of the space form a front trough and a back trough respectively and a small sheaf is placed on the front and back sections of the left and right hand walls of the space with a pedal located below the upper cover. A reset component includes mainly a first elastic part and a second elastic part. The first elastic part is located inside the front trough of the top cover, and the two ends have been fixed on a wire pedal. The second elastic part is placed inside the back trough of the top cover, and the two ends are fixed respectively on pedal with the wire.

6 Claims, 16 Drawing Sheets

GARBAGE CAN CAPABLE OF COMPRESING GARBAGE VOLUME

BACKGROUND OF THE INVENTION

1. Field of The Invention

The present invention relates to a garbage can capable of compressing garbage volume and, particularly, to a garbage can, which is capable of compressing the size of the garbage.

2. Description of Related Art

The garbage contained in the conventional garbage can is usually full of loose and bulgy wastes so that it is required to fill in a lot of garbage bags. Especially, in case of the handling fees for the garbage being counted with the number of the garbage bags, the expenses resulting from the garbage bags become much high.

SUMMARY OF THE INVENTION

An object of the present invention is to provide a garbage can capable of compressing garbage volume, with which the garbage therein can be squeezed easily so that the compressed garbage occupies less space and the consumption of garbage bags can be lower down considerably.

BRIEF DESCRIPTION OF THE DRAWINGS

The features, functions and advantages of the present invention will be readily understood upon a thoughtful deliberation of the following detailed description of two preferred embodiments thereof with reference to the accompanying drawings, in which.

DETAILED DESCRIPTION OF THE PREFERRED EMBODIMENT

Figure 1:
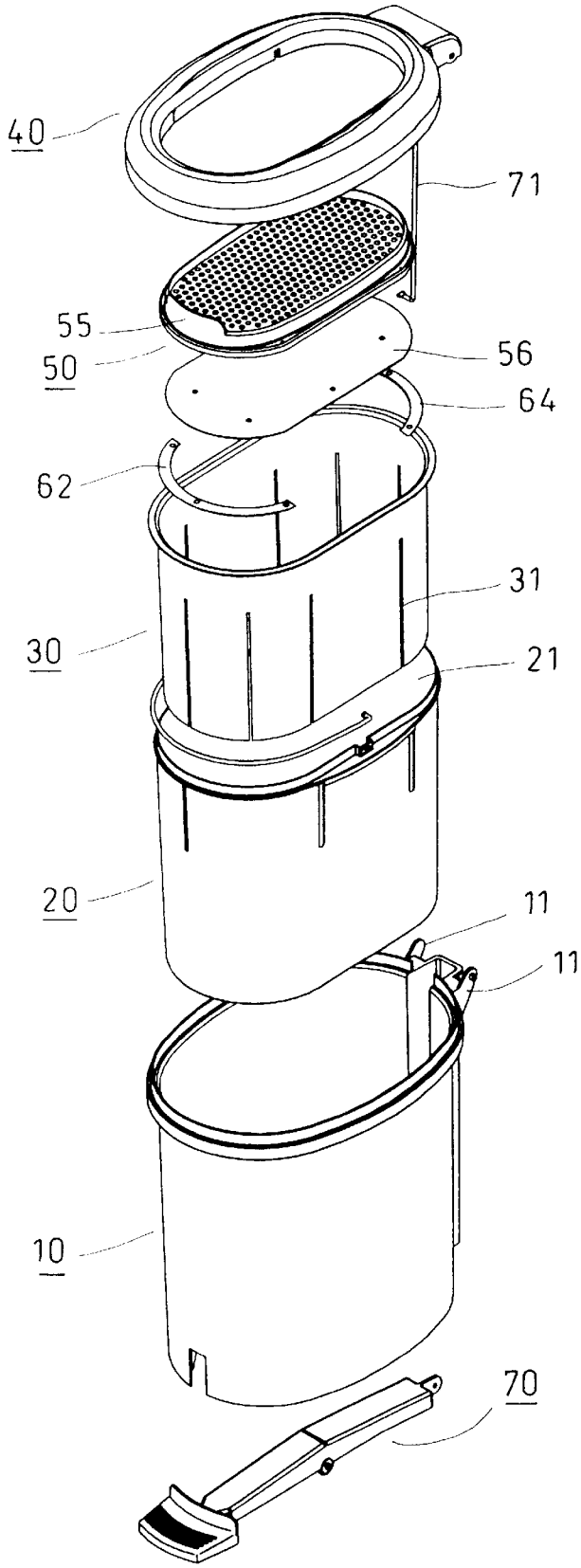
FIG. 1 is an exploded perspective view of a garbage can capable of compressing baggage volume according to the present invention with a first elastic parts (61), a second elastic parts (63), a first wire (65), a second wire (66), a third wire (67) and a fourth wire (68) being excluded.
Figure 2:
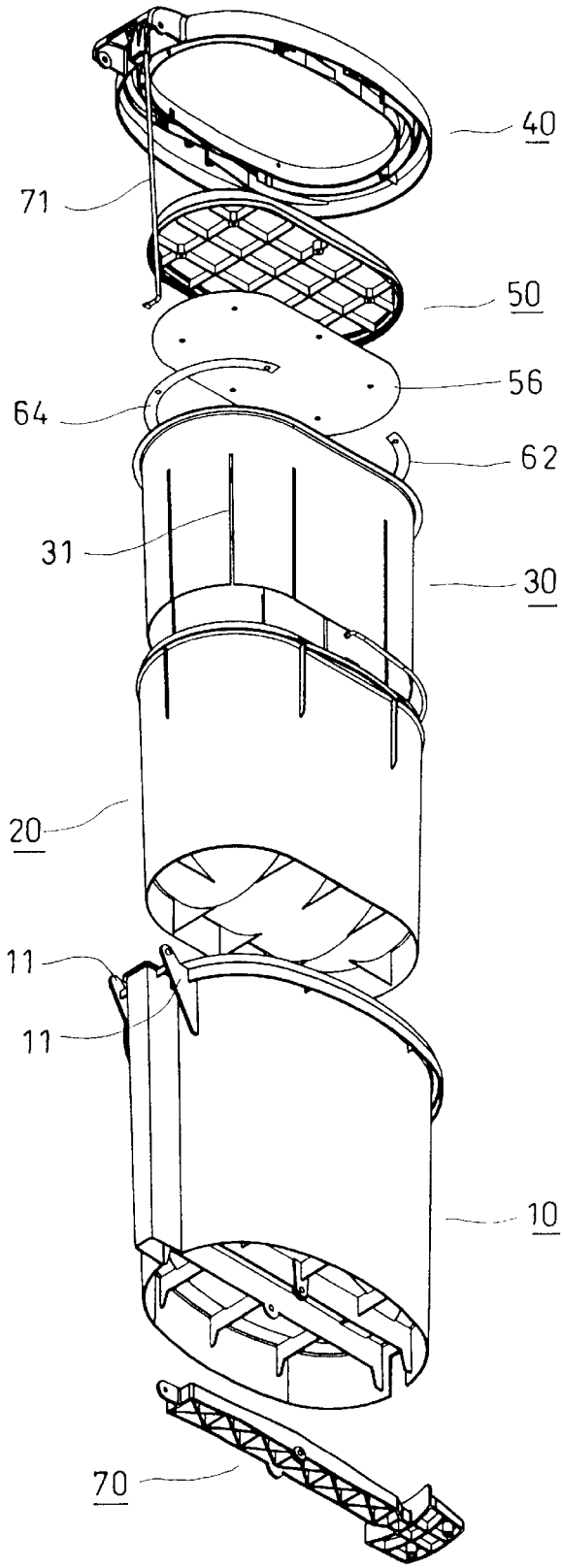
FIG. 2 is another exploded perspective view of a garbage can capable of compressing baggage volume according to the present invention projecting from the bottom thereof with a first elastic parts (61), a second elastic parts (63), a first wire (65), a second wire (66), a third wire (67) and a fourth wire (68) being excluded too.
Figure 3:
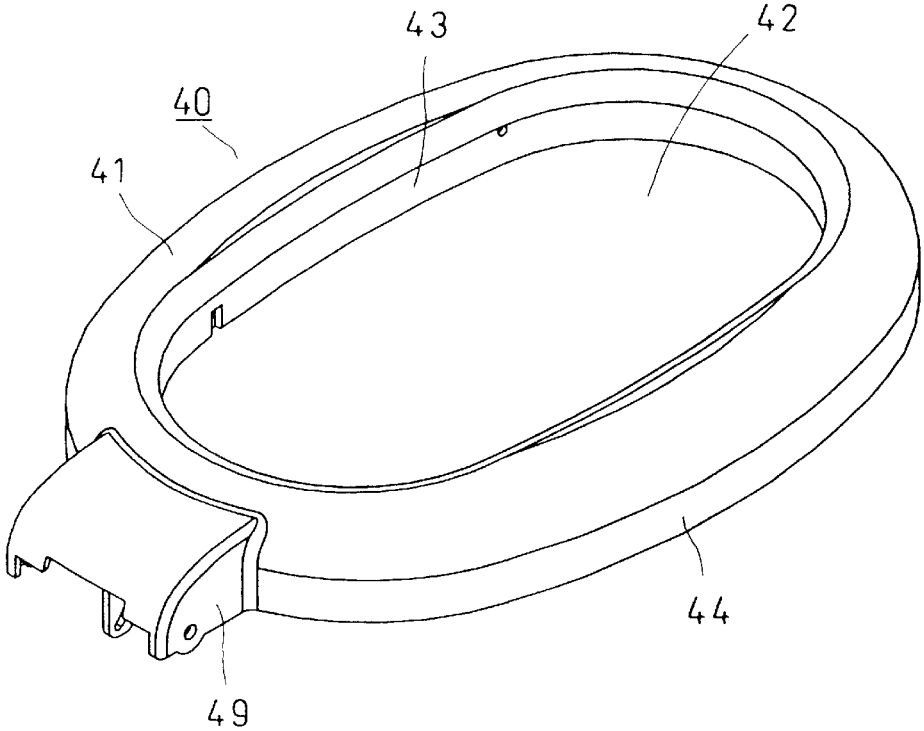
FIG. 3 is a enlarged perspective view of an upper cover shown in FIG. 1.
Figure 4:
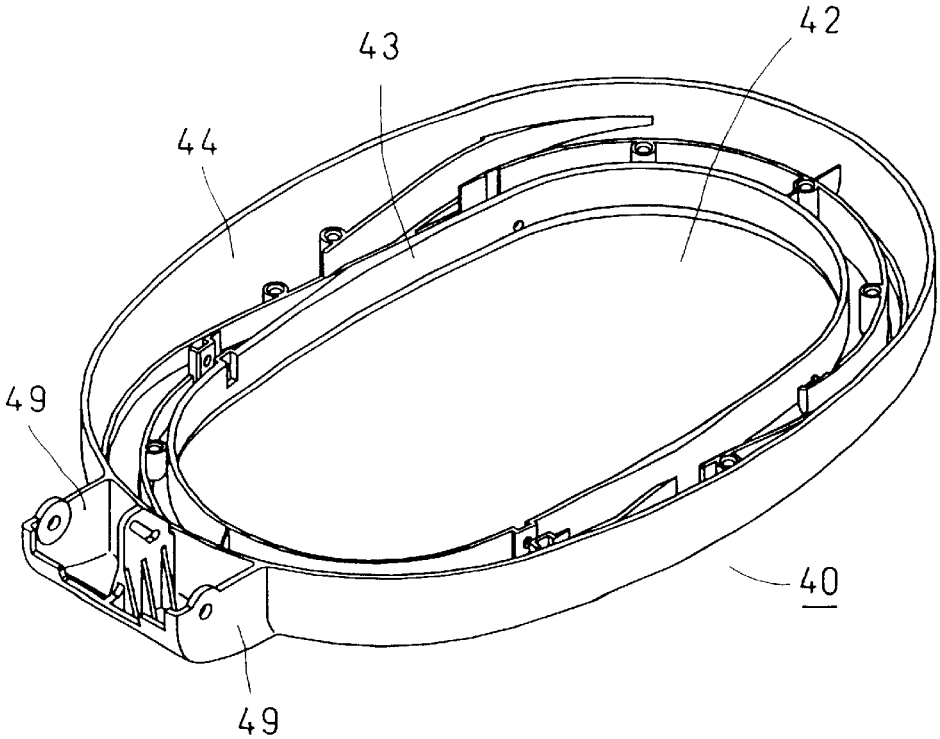
FIG. 4 is an inverted perspective view of the upper cover shown in FIG. 3.
Figure 5:
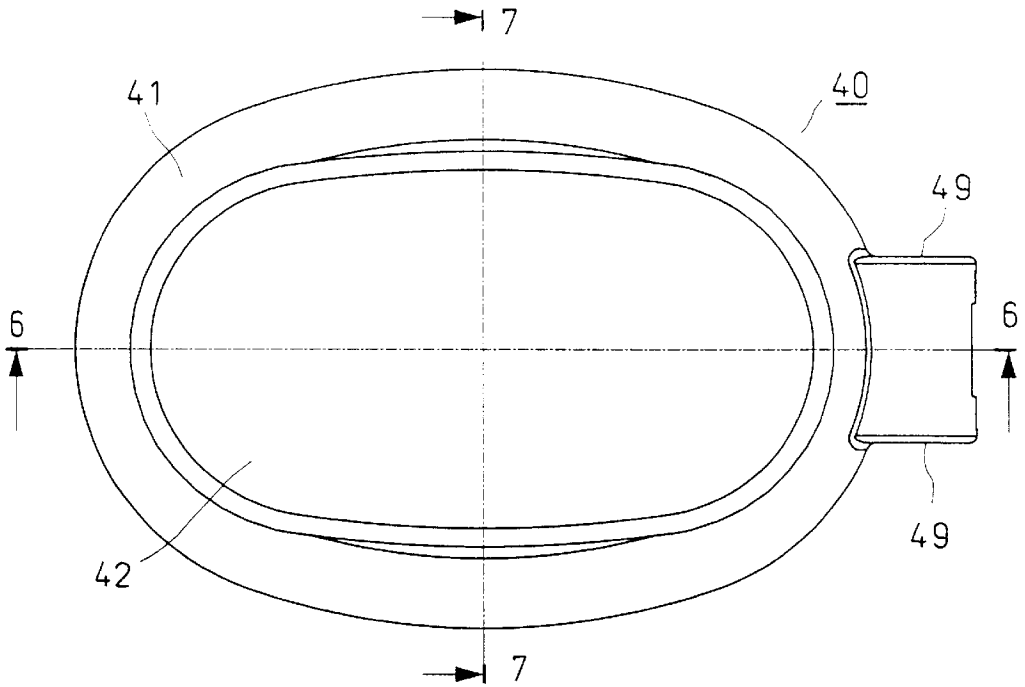
FIG. 5 is a top view of the upper cover shown in FIG. 3.
Figure 6:
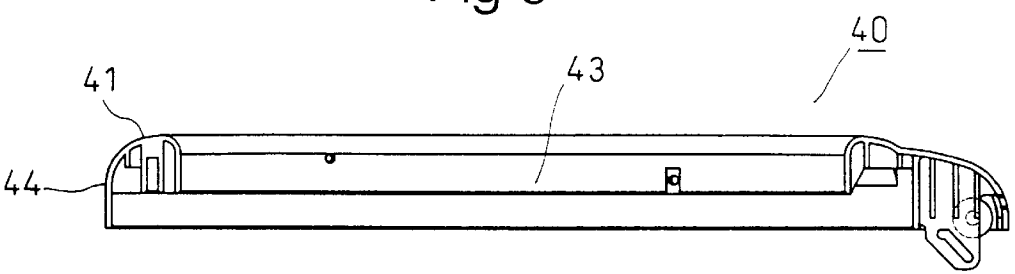
FIG. 6 is a sectional view along line 6—6 shown in FIG. 5.
Figure 7:
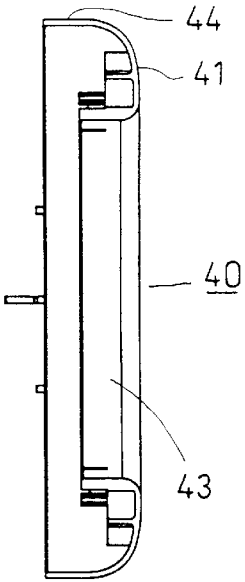
FIG. 7 is a sectional view along the 7—7-section line in FIG. 5.
Figure 8:
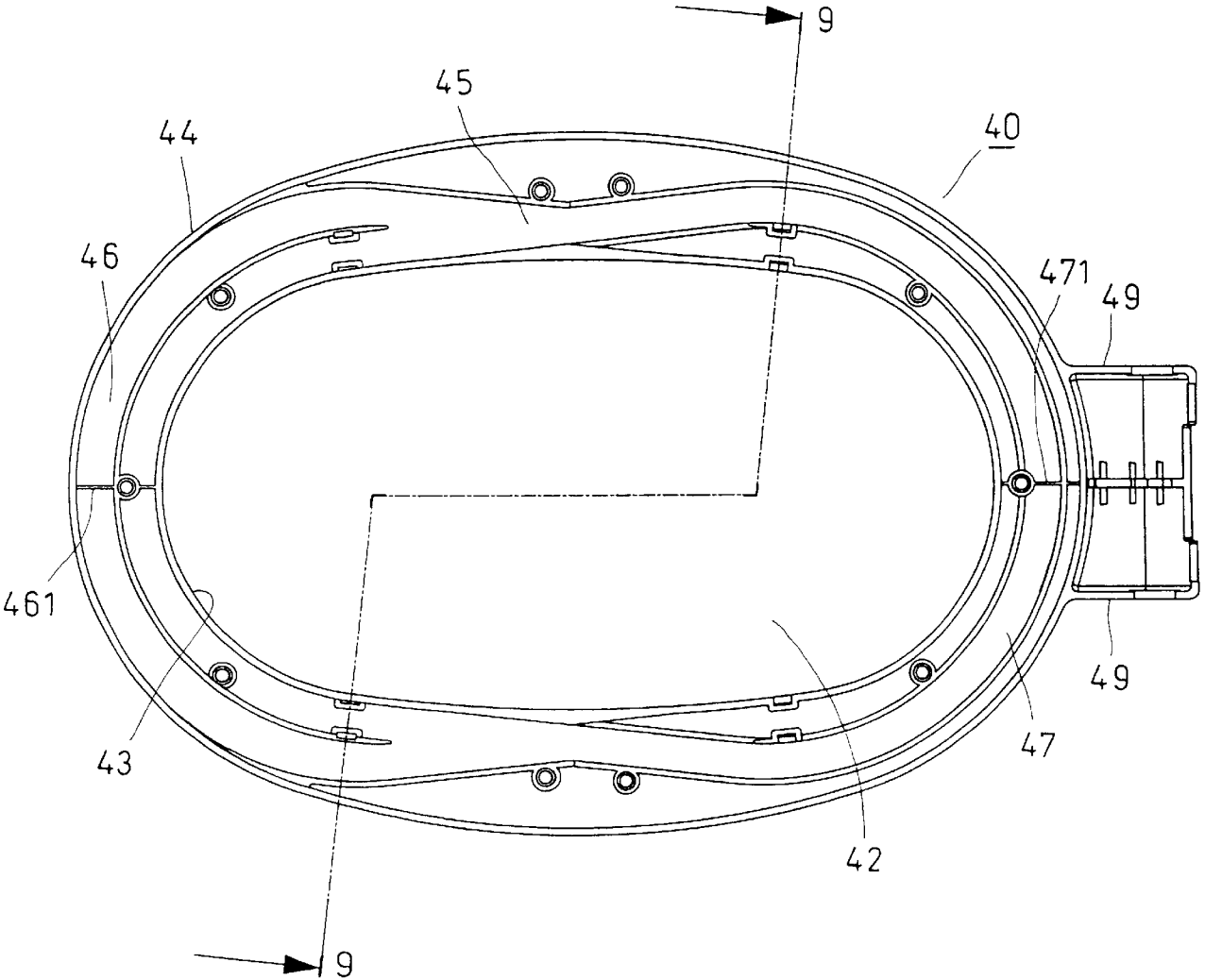
FIG. 8 is a bottom view of the upper cover shown in FIG. 5.
Figure 9:
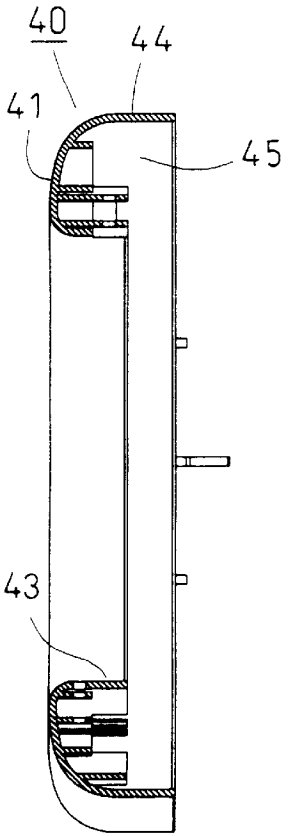
FIG. 9 is a section view along line 9—9 shown in FIG. 8.
Figure 10:
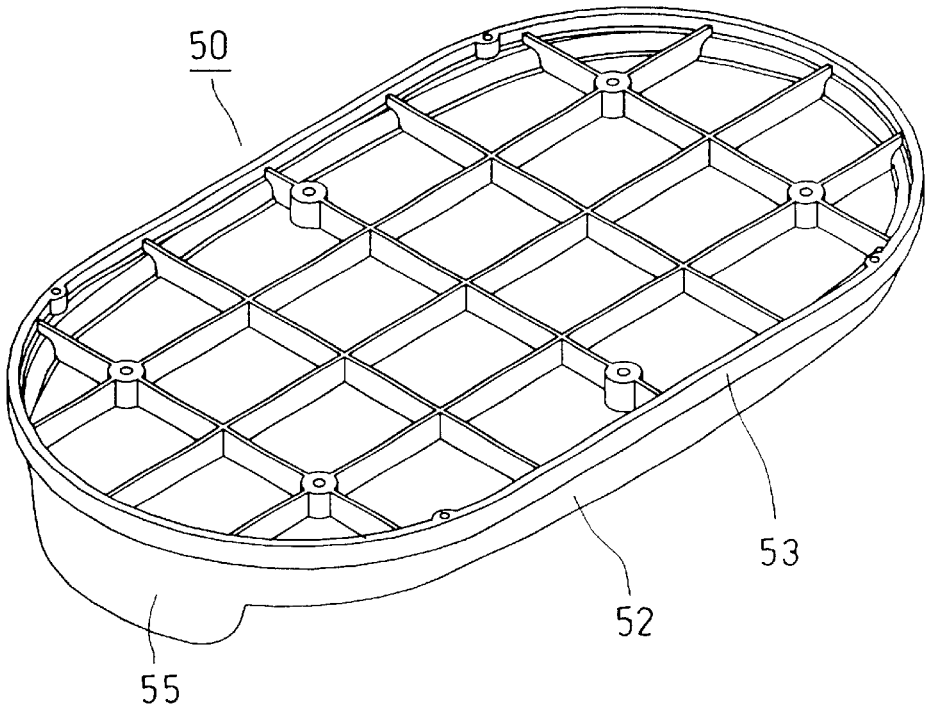
FIG. 10 is a perspective view of a pedal shown in FIG. 1.
Figure 11:
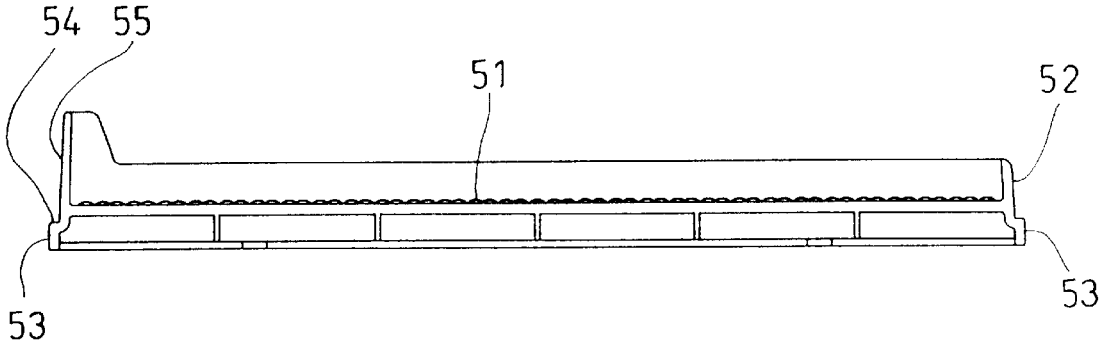
FIG. 11 is a sectional view of the pedal shown in FIG. 10.

The present invention is a garbage can that is able to compress garbage volume.

The garbage in the garbage can in general is usually very loose, which is a waste of the garbage bag, a concern especially in the area charging "receiving fees as per bag".

The idea of this invention is to solve the upper loss i.e. the garbage can enables users to easily compress the garbage inside the garbage bag so as to reduce garbage volume.

The preferred execution examples are listed below, with diagrams, to explain the structural features of this invention.

Referring to FIGS. 1 to 18, a garbage can capable of compressing garbage volume according to the present invention includes an outer cylinder (10, an inner cylinder (20), a top cylinder (30), a top cover (40), a pedal (50), reset component (60) and a pedal lever (70).

The outer cylinder (10) has an open top and the cross section transverse the body thereof is an oval shape with a first connection (11) at the rear end of the top.

The inner cylinder (20) has an open top and a receiving space. The outer diameter of the inner cylinder (20) is a little smaller than the internal diameter of the outer cylinder (10) so that the inner cylinder (20) can be inserted into the outer cylinder (10).

a top cylinder (30) with an upper bottom ending in a transparent arrangement, and with an outside diameter smaller than the internal diameter of the inner cylinder (20), so that the top cylinder (30) can be inserted into the inner cylinder (20). In addition, a long strip hole (31) with several intervals in the preset distance has been bored from the bottom edge of the top cylinder (30).

The top cover (40) has a top plate (41) with a through hole (42). The circumference of the through hole (42) extends downwards to form an inner wall (43), and the outer circumference of the top plate (41) extends downwards to form an outer wall (44) and a holding space (45) between the outer wall (44) and the inner wall (43). The front and rear ends of the space (45) respectively form the front trough (46) and back troughs (47). The first block board (461) has been placed in the middle section of the front trough (46), and the second block board (471) has been placed in the middle section of the back trough (47). Small sheaf (481) (482) (483) (484) has been respectively set in the front and back sections of the left and right side-wall of the space (45) inside the inner wall (43). The second pin connection (49) has been placed on the rear end of the top cover (40) so that the second pin connection (49) can be inserted into the first pin connection (11) of the outer cylinder (10).

The pedal (50) has a main board (51) and the circumference of the main board (51) has a small diameter (52) and a big diameter (53). A shoulder (54) is formed between the small diameter (52) and the big diameter (53) , and a groove trample trough is fenced between the small diameter (52) and the main board (51). The periphery of the small diameter (52) is a little smaller than the size of the inner wall (43) of the top cover (40). The front side of the main board (51) extends upwards to a block board (55) with proper width and height, and a metal sheet (56) is set at the bottom of the pedal (50), and the metal sheet (56) will adopt a stainless steel sheet.

Figure 12:
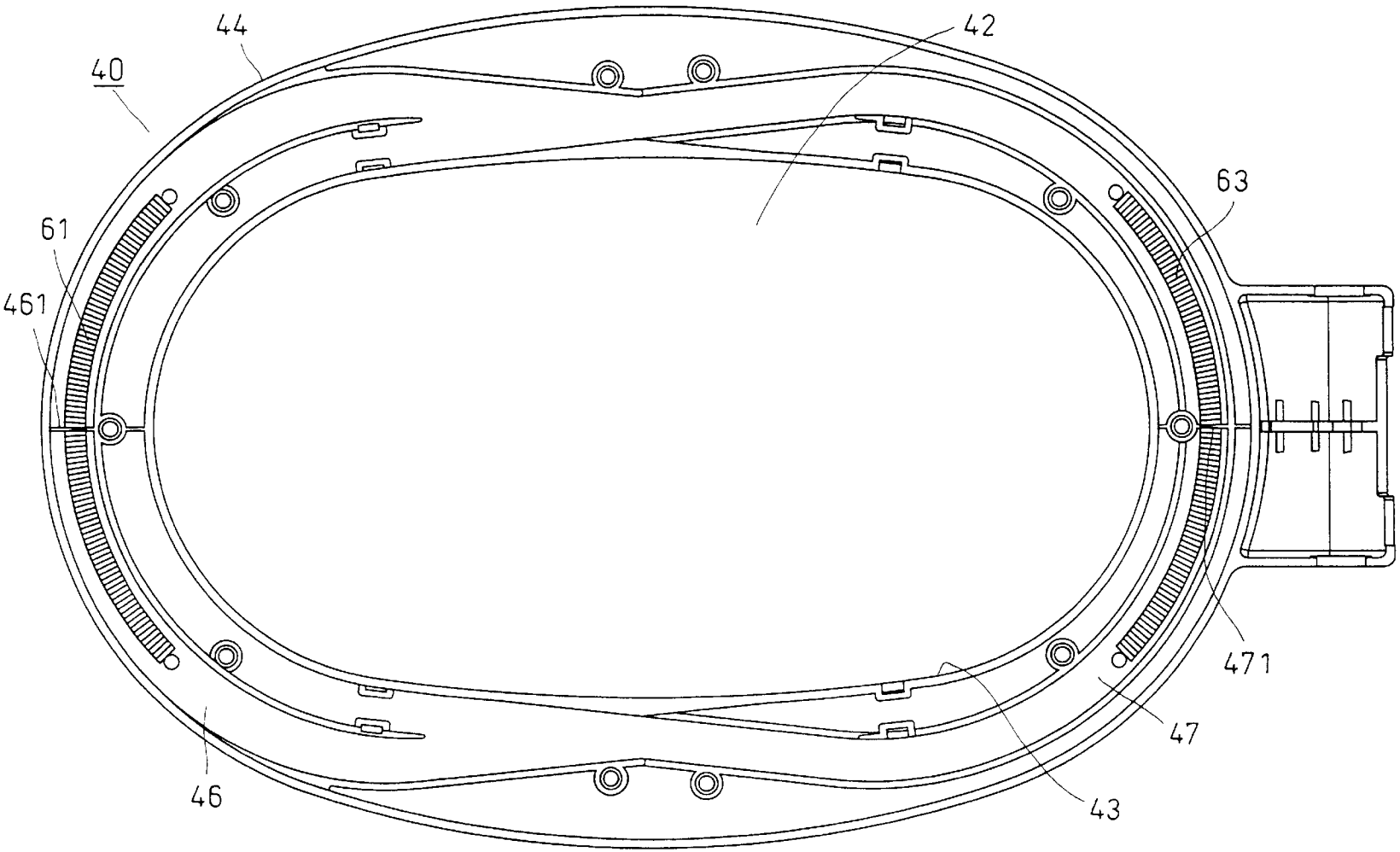
FIG. 12 is a plan view illustrating a first elastic part and a second elastic part being mounted in the upper cover.
Figure 15:
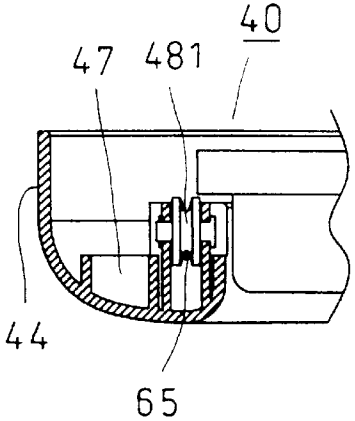
FIG. 15 is a sectional view along line 15—15 shown in FIG. 13.
Figure 13:
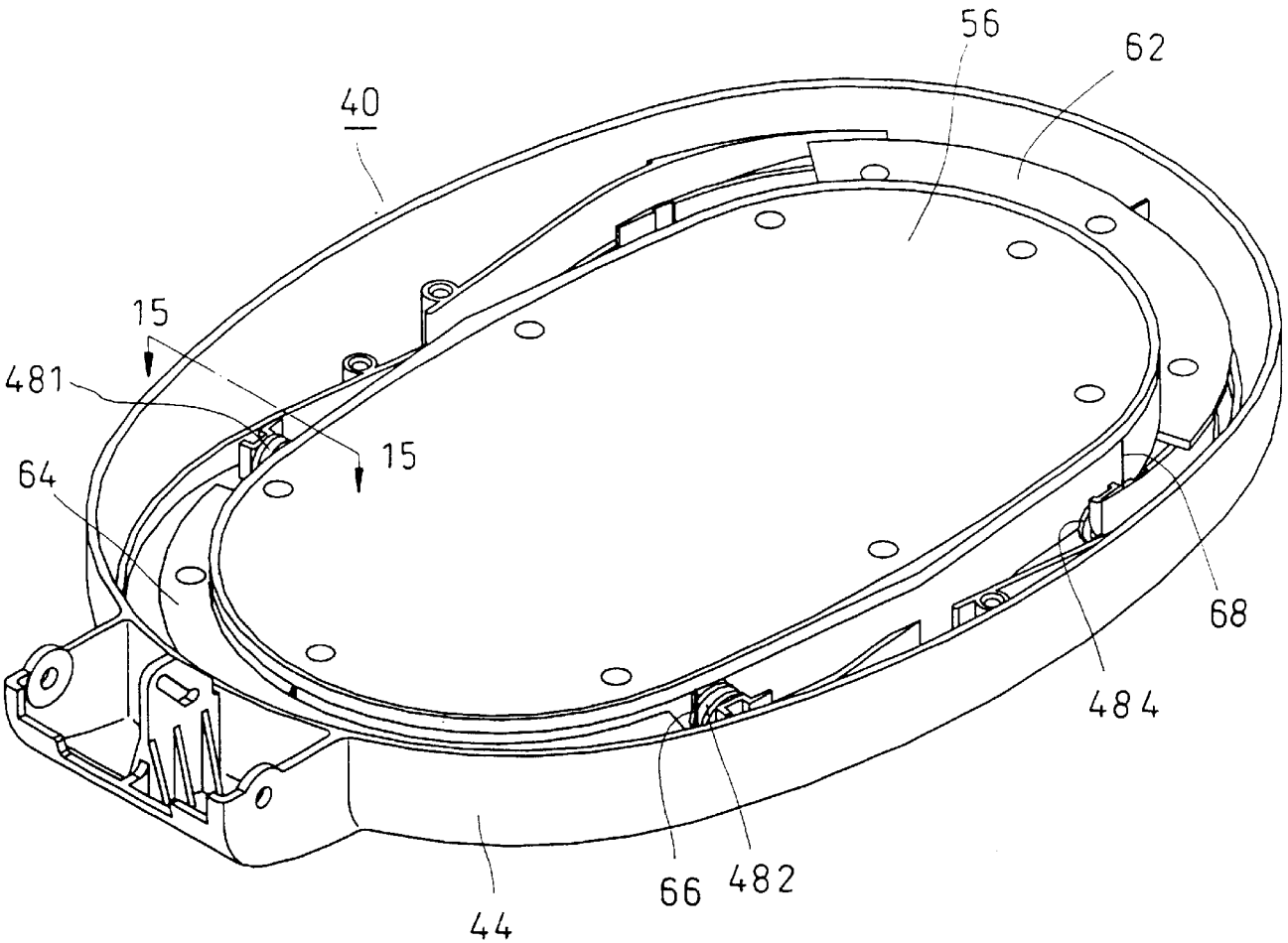
FIG. 13 is a perspective view illustrating the upper cover being assembled with the pedal and a reset component.
Figure 14:
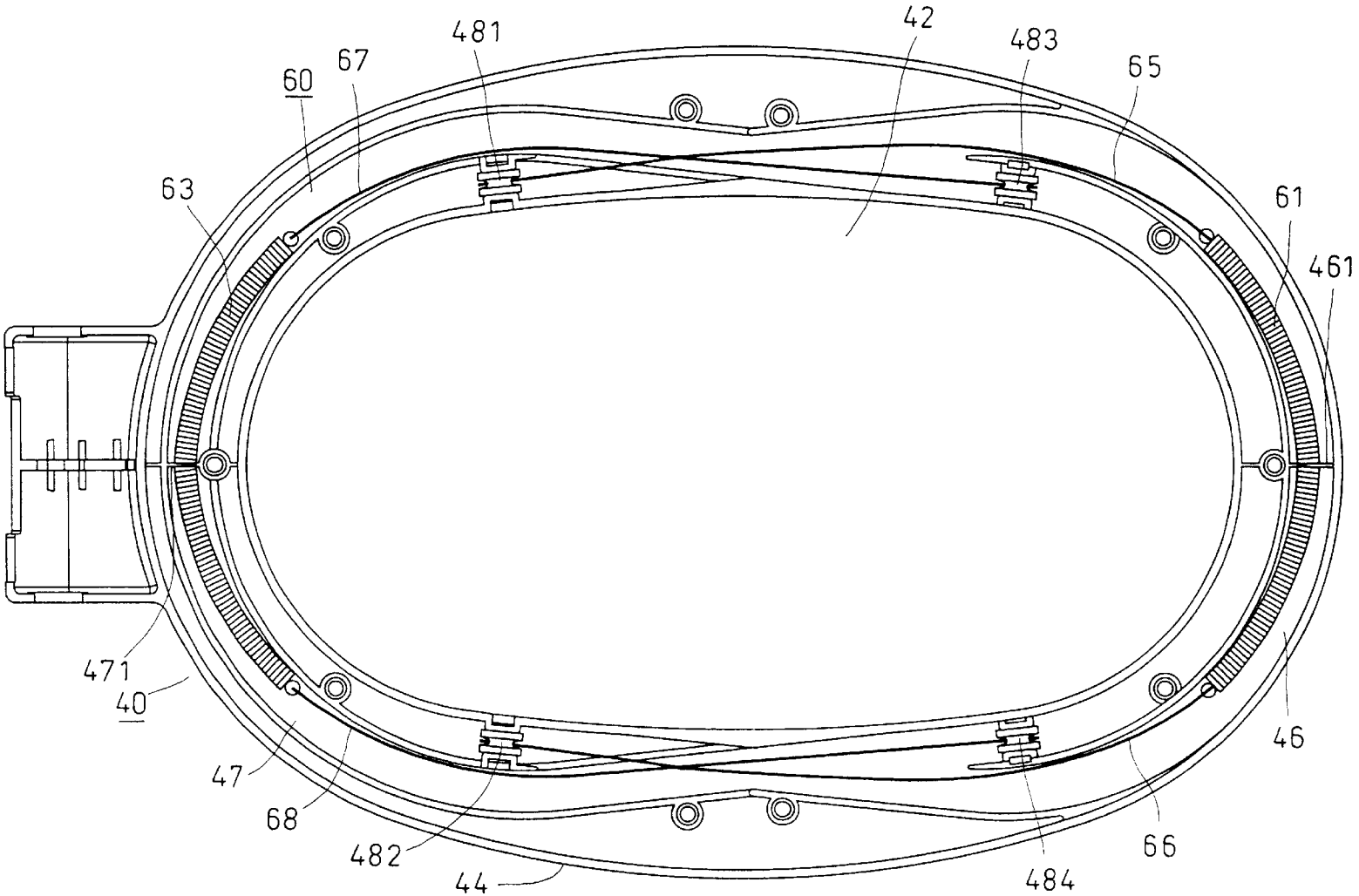
FIG. 14 is a plan view illustrating the reset component being installed on the top cover.
Figure 16:
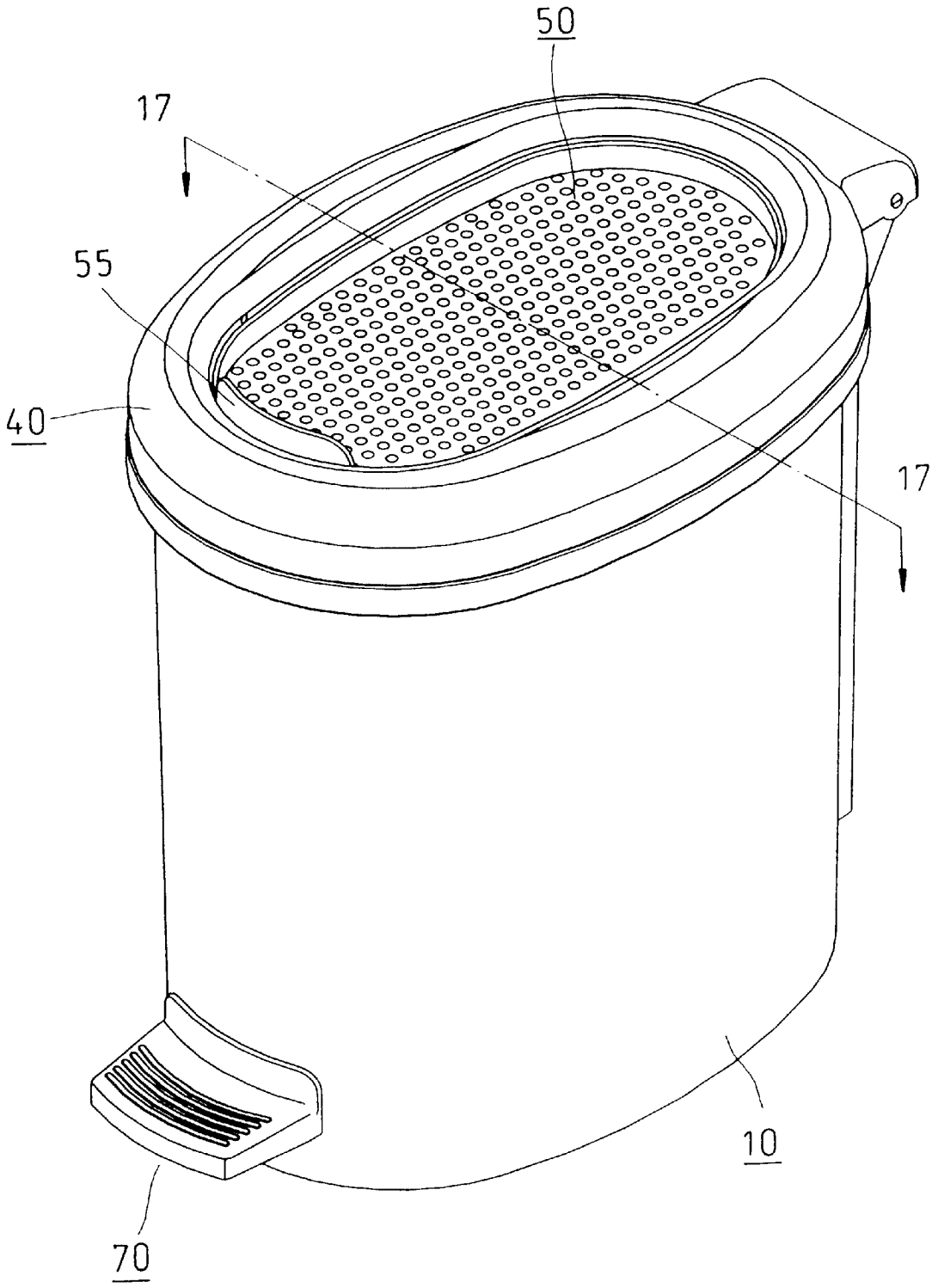
FIG. 16 is a perspective view of the garbage showing an appearance thereof.
Figure 17:
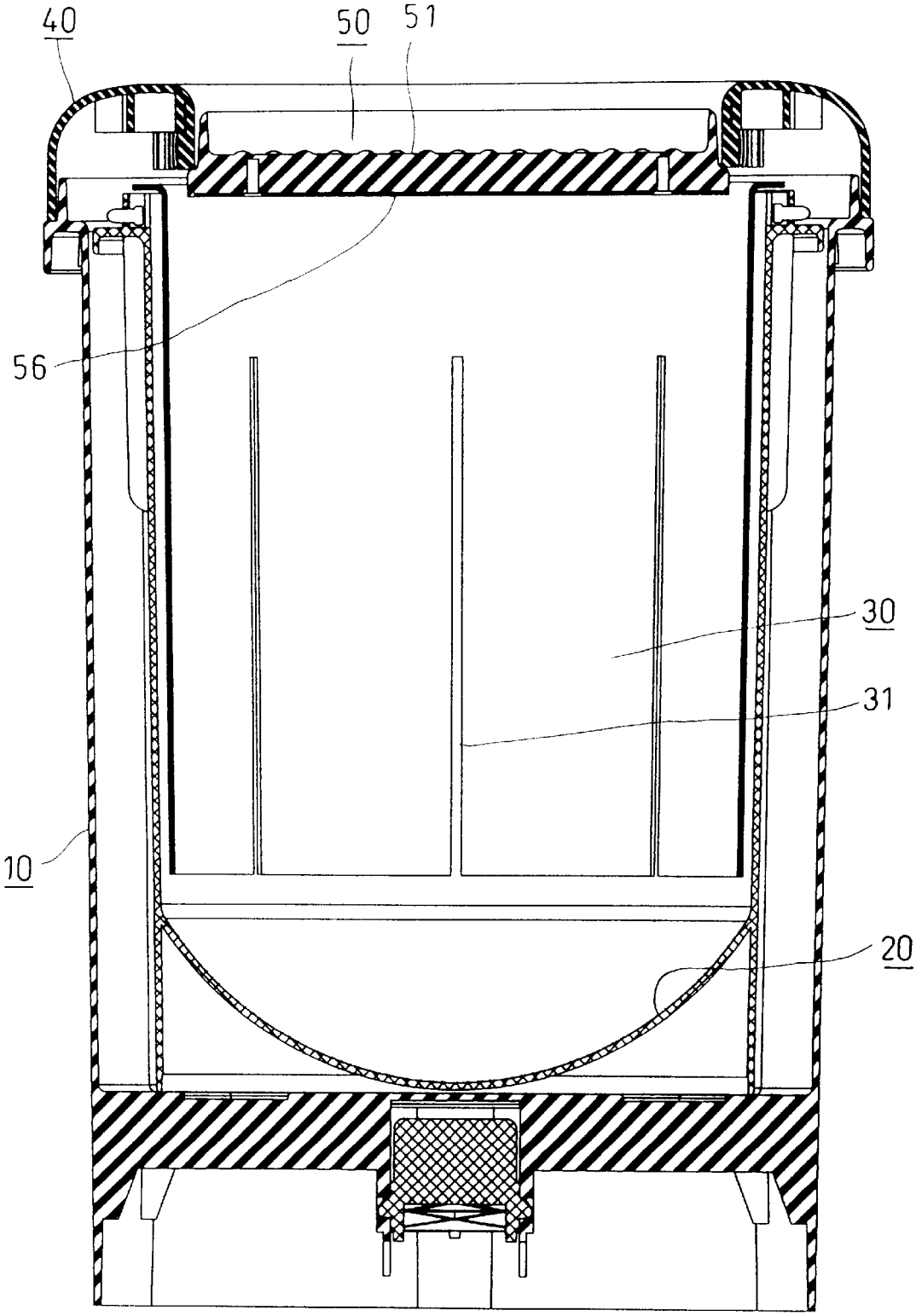
FIG. 17 is a sectional view along line 17—17 shown in FIG. 16.
Figure 18:
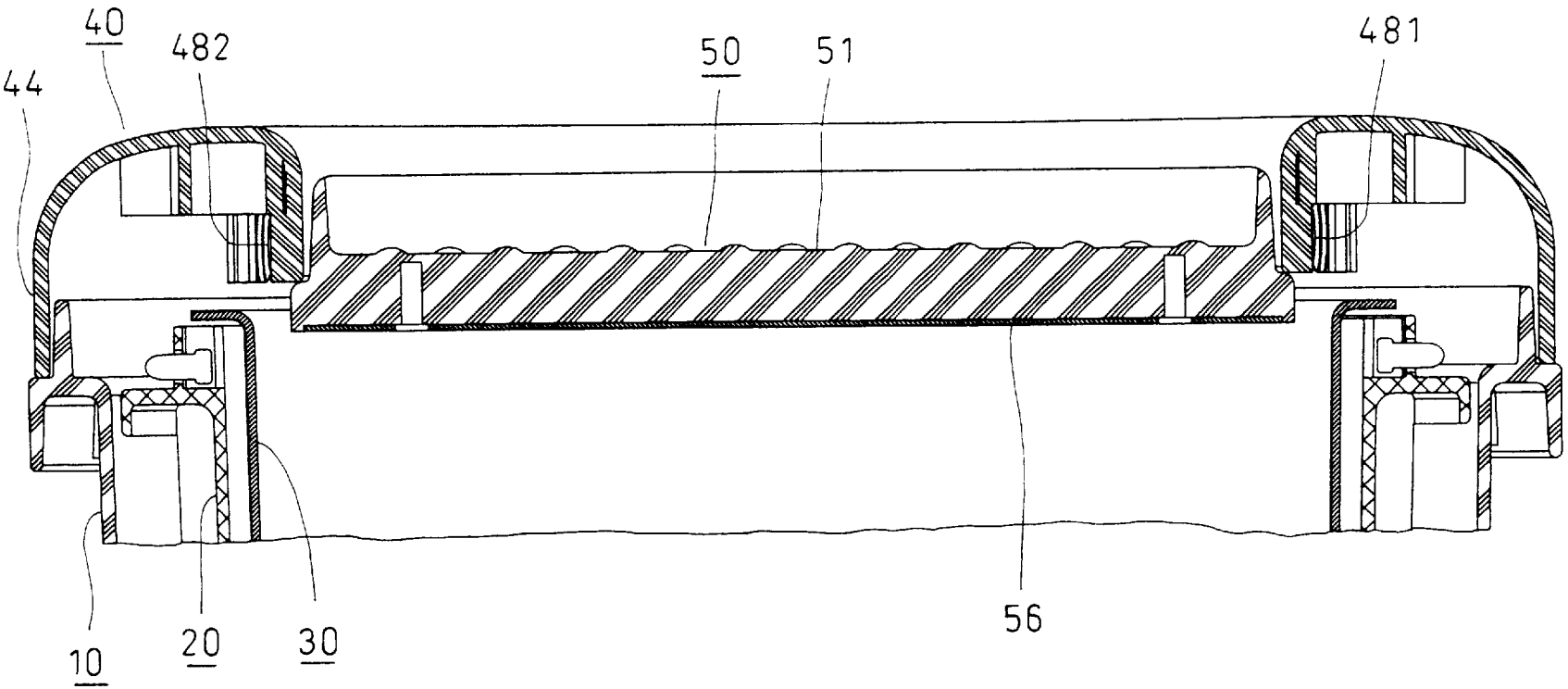
FIG. 18 is a fragmentary enlarged sectional view of the upper section of FIG. 17.

The reset component (60), including the first elastic parts (61) made of extension spring, as shown in FIG. 12, has been inserted into the front trough (46) of the top cover (40), and its middle section has been inserted into the first block board (461). The first shroud (62) is fixed below the front trough (46) to prevent the first elastic parts (61) from disengaging from the front trough (46). The second elastic parts (63) which also adopts an extension spring, as shown in FIG. 12, has been inserted into the back trough (47) of the top cover (40), and its middle section has been inserted into the second block board (471). The second shroud (64) has been inserted below the back trough (47) to prevent the second elastic parts (63) from disengaging from the back trough (47). The first wire (65), with one end is attached to the left end of the first elastic parts (61). The other end bypassing the small sheaf (481) at the back section of the left side has been inserted into the left side back section of the shoulder (54) of the pedal (50). The second wire (66), with one end attached to the right side of the first elastic parts (61), the other end bypassing the small sheaf (482) at the back section of the right side, is attached to the right-side back section of the shoulder (54) of the pedal (50). The third wire (67), with one end attached to the left end of the second elastic parts (63), the other end bypassing the small sheaf (483) at the front section of the left side, is attached to the left-hand front section of the shoulder (54) of the pedal (50). The fourth wire (68), with one end attached to the right end of the second elastic parts (63), the other end bypassing the small sheaf (484) at the front section of the right side, is attached to the right-hand front section of the shoulder (54) of the pedal (50). Under normal conditions, the shoulder (54) of the pedal (50) nearly reaches the bottom of the inner wall (43).

The pedal lever (70) is connected to the bottom of the outer cylinder (10), and the rear end is connected to the bottom of the link (71), and the top of the link (71) is connected to the rear end of the top cover (40).

Figure 19:
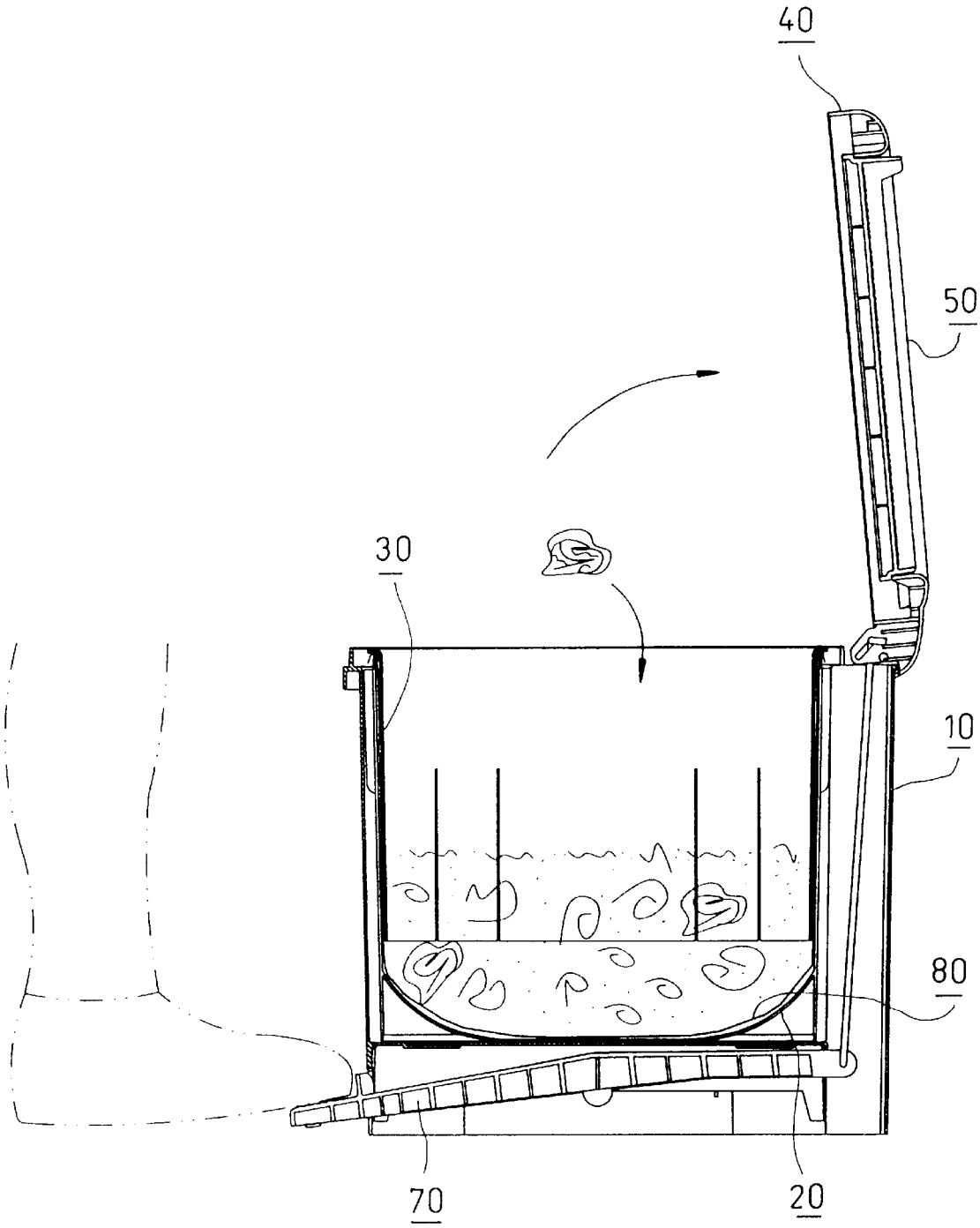
FIG. 19 is a plan view illustrating the upper cover being opened for the garbage being discarded.

As indicated in FIG. 19, a garbage bag (80) has been placed between the inner cylinder (20) and the top cylinder (30), just like general garbage can. The user stepping down the front-end of the trample rod (70) is able to open the top cover (40) and discard the garbage inside the garbage can.

Figure 20:
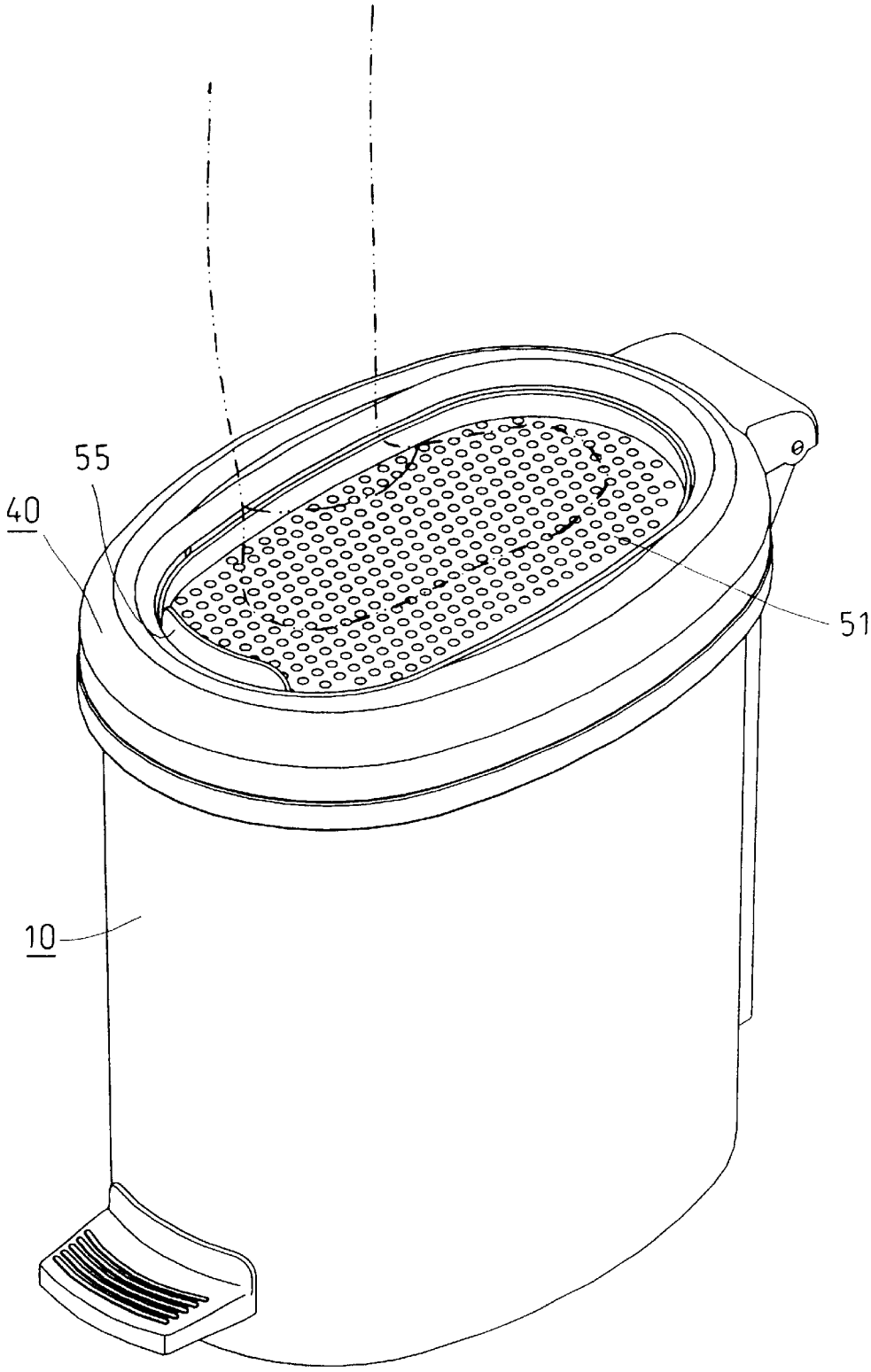
FIG. 20 is a perspective view illustrating a user stepping on the pedal.
Figure 21:
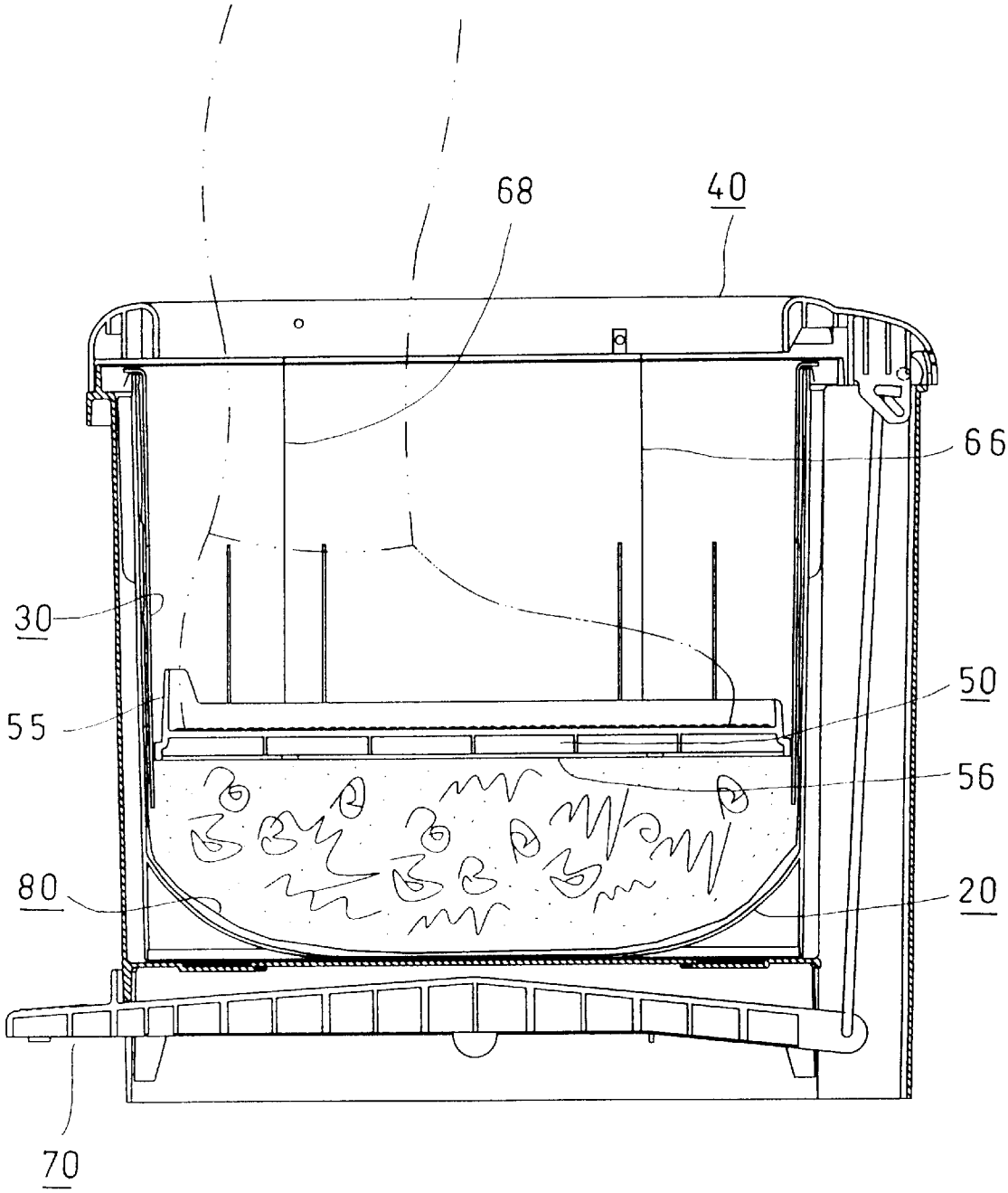
FIG. 21 is a sectional view illustrating the pedal having been stepped to move downward and compress the garbage in the garbage can.
Figure 22:
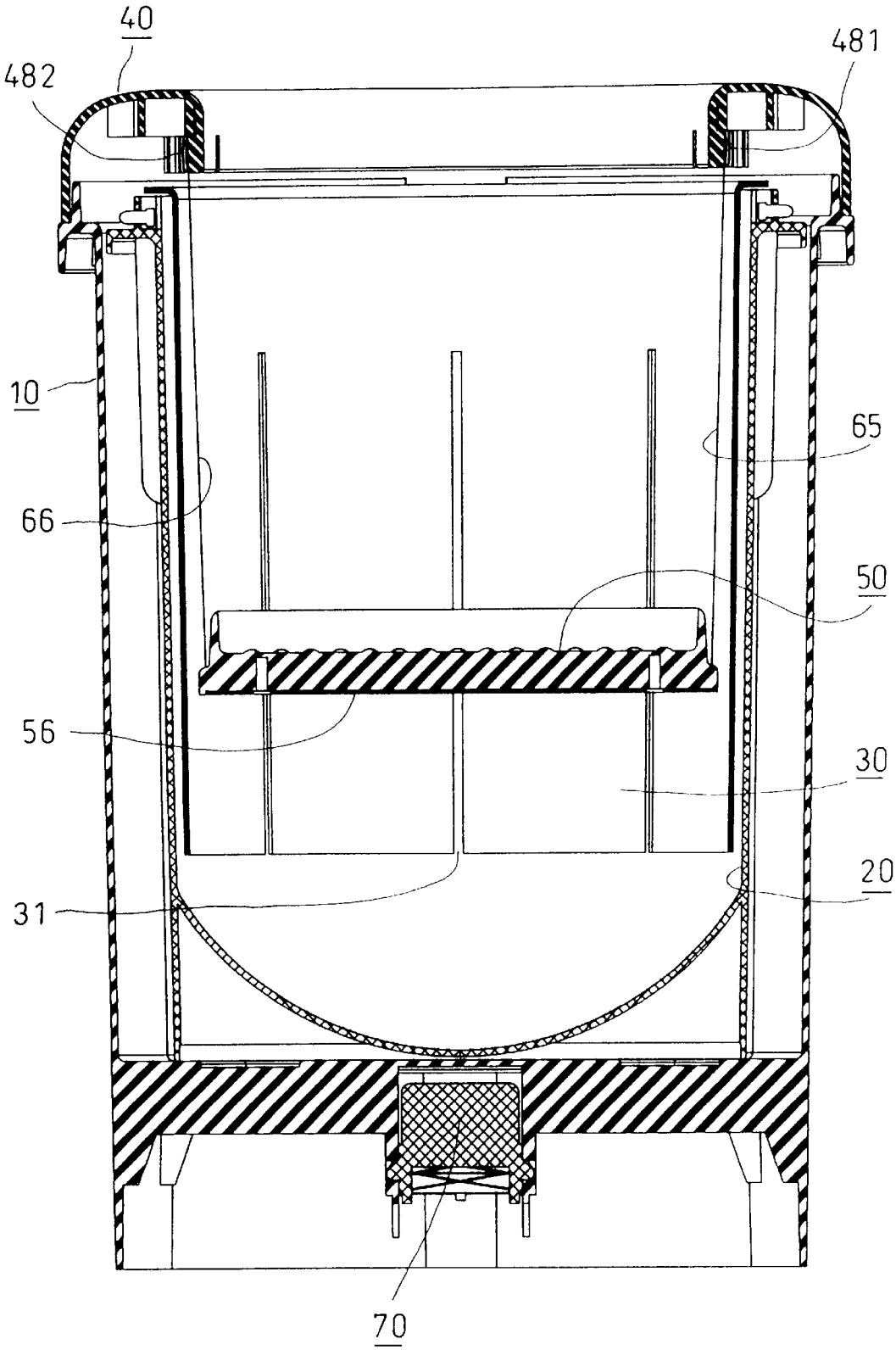
FIG. 22 is a sectional view illustrating a position of the pedal relative to the upper cover after the pedal being stepped down.

When the garbage reaches roughly 70 or 80 percent of the garbage can, as shown in FIG. 20, the user can step into the trample trough of the pedal (50), and then step down with force. The force applied by the user can lengthen the first elastic parts (61) and the second elastic parts (63). As shown in FIG. 21 and 22, the pedal (50) can fall, thus enabling the compression of the garbage to be able to hold more garbage.

When the foot is lifted, the first elastic parts (61) and the second elastic parts (63) will no longer be compressed, as its restoration will return the pedal (50) to its original position.

Installing a metal sheet (56) at the bottom of the pedal (50) will prevent the user'2s foot from injury by sharp objects, such as glass or iron nails etc. while being trampled upon.

In practice, the top cylinder (30) can be directly inserted into the outer cylinder (10) instead of using the inner cylinder (20).

While the invention has been described with reference to the preferred embodiments thereof, it is to be understood that modifications or variations may be easily made without departing from the spirit of this invention, which is defined by the appended claims.

What is claimed is:

1. A garbage can capable of compressing garbage volume, comprising:

an outer cylinder opening up;

a top cylinder with a transparent top bottom end, and outside diameter smaller than the internal diameter of the outer cylinder, so that the top cylinder can be inserted into the outer cylinder;

a top cover, having a top plate with a through hole, the circumference of the through hole extending downwards to form an inner wall, the outer circumference of the top plate extending downwards to form an outer wall, and a space between the outer and inner walls; a front and a back sides of the space respectively forming a front and a back troughs, the first block board being set in the middle section of the front trough, and the second block board being set in the middle of the back trough, a small sheaf being respectively set at a front and a back sections of a left and a right walls of the space, and an rear end of the top cover being a pin connected to the rear end of the outer cylinder;

a pedal with a main board, a circumference of the main board forming a small and a big diameters, and a groove trample trough being fenced between the small diameter and the main board, a shoulder being formed between the small and the big diameters, and the periphery of the small diameter being a little smaller than the inner wall size of the top cover;

a reset component, further comprising a first elastic part fixed into the front trough of the top cover, a middle section thereof having been attached to a first block board, a first shroud being fixed below the front trough, a second elastic part having been inserted into the back trough of the top cover with a middle section thereof being fixed into the second block board, a second shroud being fixed below a holding trough, a first wire with one end thereof attached to a left end of the first elastic part and the other end thereof bypassing the small sheaf at the back section on a left side thereof being attached to the back section of the left side on the shoulder of the pedal, a second wire with one end thereof attached to a right end of the first elastic part and the other end thereof bypassing the small sheaf at the back section on the right side being attached to the back section on the right side of the shoulder of the pedal, a third wire with one end thereof attached to the left end of the second elastic parts and the other end thereof bypassing the small sheaf at the back section of the left side being attached to the front section on the left hand of the shoulder of the pedal, a fourth wire with one end thereof attached to the right end of the second elastic parts, the other end thereof bypassing the small sheaf at the back section on the right side being attached to the front section on the right side of the shoulder of the pedal;

wherein, under normal conditions, the shoulder of the pedal just reaching a bottom of the inner wall; and a garbage bag being placed between the outer and top cylinders.

2. The garbage can capable of compressing garbage volume as defined in claim 1, wherein a stretching spring can be adopted as the first and the second elastic parts respectively.

3. The garbage can capable of compressing garbage volume as defined in claim 1, wherein a metal sheet is attached to the bottom of the pedal.

4. The garbage can capable of compressing garbage volume as defined in claim 2, wherein a metal sheet is attached to the bottom of the pedal.

5. The garbage can capable of compressing garbage volume as defined in claim 1, wherein a long strip slotted hole preset at several intervals is opened upwards from the bottom of the top cylinder and the garbage can further comprises an inner cylinder and a pedal lever, the inner cylinder having a receiving space with an open top and an outside diameter being a little smaller than the internal diameter of the outer cylinder so that the inner cylinder can be placed into the outer cylinder, the pedal lever being connected to a bottom of the outer cylinder and a rear end thereof being connected to a bottom of a link in case of a top end of the link being connected to a backside of the top cover.

6. The garbage can capable of compressing garbage volume as defined in claim 2, wherein a long strip slotted hole preset at several intervals is opened upwards from the bottom of the top cylinder and the garbage can further comprises an inner cylinder and a pedal lever, the inner cylinder having a receiving space with an open top and an outside diameter being a little smaller than the internal diameter of the outer cylinder so that the inner cylinder can be placed into the outer cylinder, the pedal lever being connected to a bottom of the outer cylinder and a rear end thereof being connected to a bottom of a link in case of a top end of the link being connected to a backside of the top cover.

* * * * *